US006352062B1

(12) United States Patent
Ferrea

(10) Patent No.: US 6,352,062 B1
(45) Date of Patent: Mar. 5, 2002

(54) ROLLER ROCKER ARM ASSEMBLY

(76) Inventor: Horacio O. Ferrea, 2600 NW. 55 Ct., Suite 238, Fort Lauderdale, FL (US) 33309

( * ) Notice: Subject to any disclaimer, the term of this patent is extended or adjusted under 35 U.S.C. 154(b) by 0 days.

(21) Appl. No.: 09/676,683

(22) Filed: Sep. 29, 2000

(51) Int. Cl.[7] ..... F01L 1/26; F01L 1/18

(52) U.S. Cl. ..... 123/90.22; 123/90.42; 123/90.45; 74/559

(58) Field of Search ..... 123/90.22, 90.39, 123/90.4, 90.42, 90.44, 90.45; 74/519, 559

(56) References Cited

U.S. PATENT DOCUMENTS 5,680,835 A * 10/1997 Ruffing et al. ..... 123/90.16
6,055,951 A * 5/2000 Rommer et al. ..... 123/90.22
6,237,552 B1 * 5/2001 Hoag, Jr. ..... 123/90.22

* cited by examiner

*Primary Examiner*—Weilun Lo
(74) *Attorney, Agent, or Firm*—J. Sanchelima; A. Bordas

(57) ABSTRACT

Internal combustion engine valve roller rocker arm system designed to manipulate horsepower output of an equipped engine. Each roller rocker arm system is formed of two arm members pivotally mounted to a common shaft and are joined together by a pin through roller bearings. As a conventional camshaft rotates, it contacts the roller bearing causing a conventional valve to attain an open valve position through the arm assemblies.

5 Claims, 5 Drawing Sheets

ROLLER ROCKER ARM ASSEMBLY

BACKGROUND OF THE INVENTION

1. Field of the Invention.

The present invention relates to combustion engine components, and more particularly, to a roller rocker arm system for operation in an internal combustion engine.

2. Description of the Related Art.

Internal combustion engines are the most popular source of power for many vehicles, especially automobiles, boats, and motorcycles. The sport of auto, boat, and motorcycle racing in particular, require specially manufactured engine components to maximize horsepower to ultimately achieve top performance. One of such components is the rocker arm system. Rocker arm systems are driven by a camshaft. The camshaft and crankshaft of a combustion engine are sequenced to allow a camshaft lobe to contact and follow the surface of a rocker arm, cammingly actuating it to transmit linear motion to a valve in the coordinated time to follow the piston position within a cylinder.

Presently, the surface upon which a camshaft lobe strikes is flat, causing excessive friction, wear, and deteriorated engine performance. There are no similar roller rocker arm assemblies to the best of applicant's knowledge, that utilize a roller system for a camshaft lobe to rotate upon.

SUMMARY OF THE INVENTION

It is one of the main objects of the present invention to provide a roller rocker arm system designed especially for high performance racing vehicles utilizing internal combustion engines.

It is another object of this invention to provide a roller rocker arm system made of a durable, lightweight material to improve moments of inertia and increase the revolutions per minute range of the valve train.

It is still another object of the present invention to provide a roller rocker arm system that eliminates the variable timing electronic control function.

It is yet another object of this invention to provide a roller rocker system that prevents the bearings from skidding across the camshaft lobe surface, thus reducing friction.

It is still another object of the present invention to provide a roller rocker system that may be installed without cylinder head modifications. It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
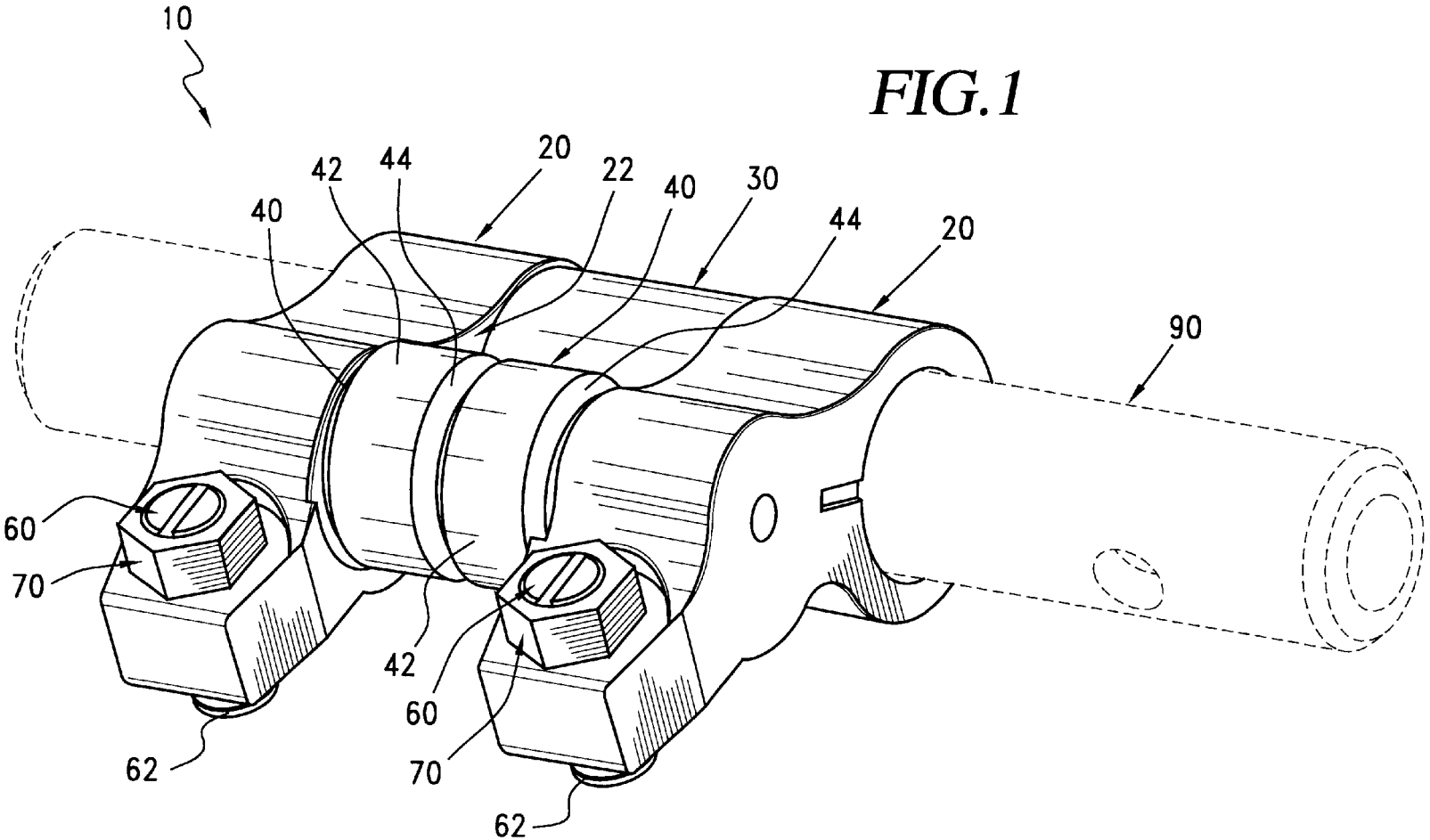
FIG. 1 represents an isometric view of the invention.

Referring now to the drawings, where the present invention is generally referred to with numeral 10, it can be observed that it basically includes rocker arm members 20, spacer sleeve 30, bearings 40, adjustable screws 60, and stop nuts 70.

As seen in FIG. 1, rocker arm members 20 and spacer sleeve 30 are pivotally mounted about common rocker shaft 90. Spacer sleeve 30 snugly fits between rocker arm members 20 establishing a predetermined spaced apart distance between rocker arm members 20, as do bearings 40. Bearings 40 have bearing shell 42 that taper to establish chamfered edges 44. Adjustable screws 60 are set at a predetermined height to establish a linear distance for valve 100, shown in FIG. 2, to travel. Stop nut 70 restricts adjustable screw 60 with sufficient force to keep adjustable screw 60 stationary while instant invention 10 is operating within an internal combustion engine. Instant invention 10 is manufactured from a durable, lightweight material such as Aluminum-Magnesium, or a material of similar characteristics to improve moments of inertia and increase the revolutions per minute range of the valve train.

Moments of inertia is defined to be the cause for momentum, which is the product of the mass of a body and its velocity. The sum of all the momenta remains unaltered in any one mechanical system.

Figure 2:
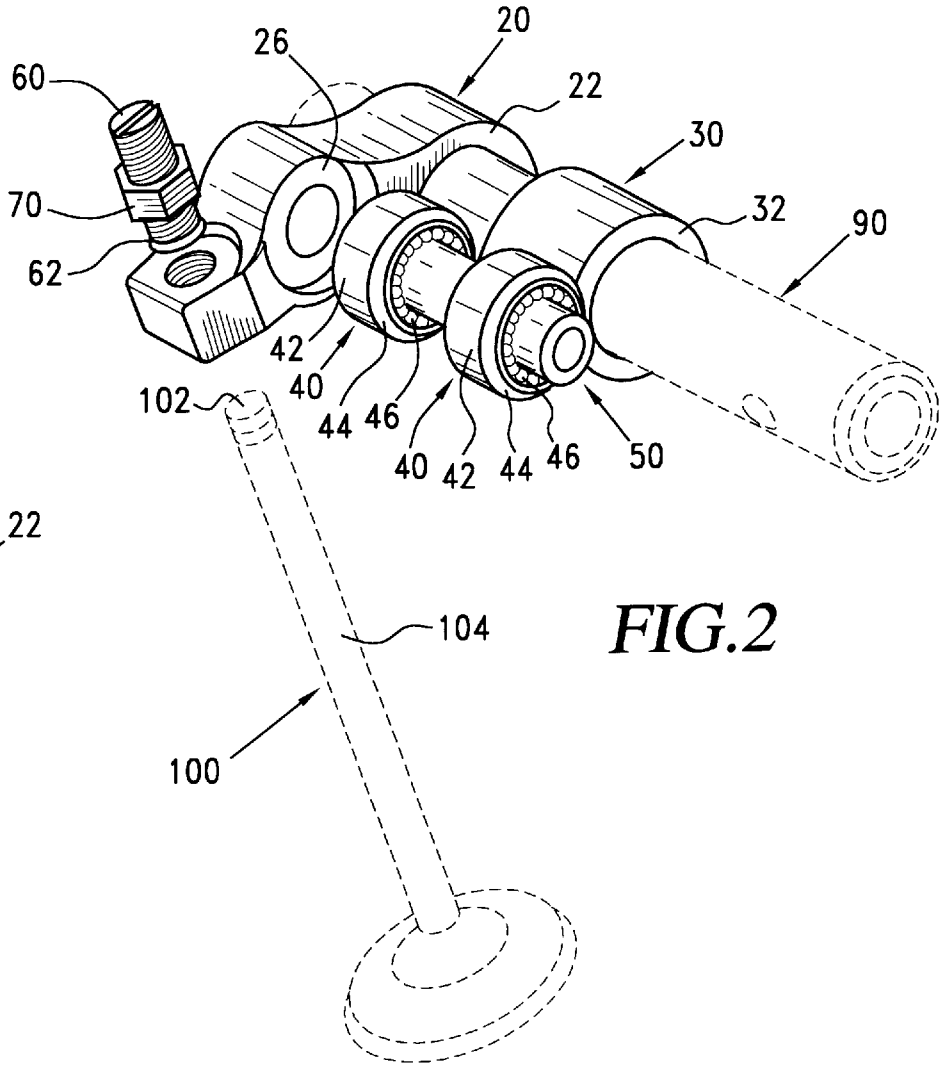
FIG. 2 shows an exploded view of one arm unit and a valve and rocker shaft shown in phantom.
Figure 2A:
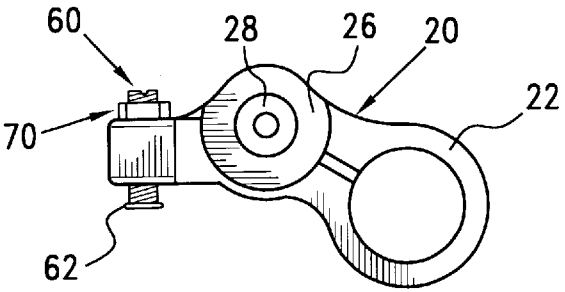
FIG. 2*a* shows an elevational side view of one arm unit.

As better seen in FIG. 2, rocker arm member 20 has interior face 22. Interior face 22 has partial generally circular face notch 26 to complement chamfered edge 44 of bearing 40 when biased against it. At a predetermined distance from face notch 26 is notched step 28, seen in FIG. 2*a*. Notched step 28 serves to contain interconnecting pin 50 snugly in place, connecting rocker arm members 20. Bearing 40 has bearing shell 42 encasing roller needles 46. Bearings 40 are designed to prevent skidding across camshaft lobe 82, shown in FIG. 5, thus reducing friction. Spacer sleeve 30 rotably fits about common rocker shaft 90 and has exterior face 32 which abuts interior face 22 of rocker arm members 20 when biased against them. Adjustable screw 60 trespasses rocker arm member 20 and serves to adjust the vertical travel of valve 100. Once adjusted to the desired height, adjustment screw 60 remains stationary with retaining stop nut 70.

Figure 3:
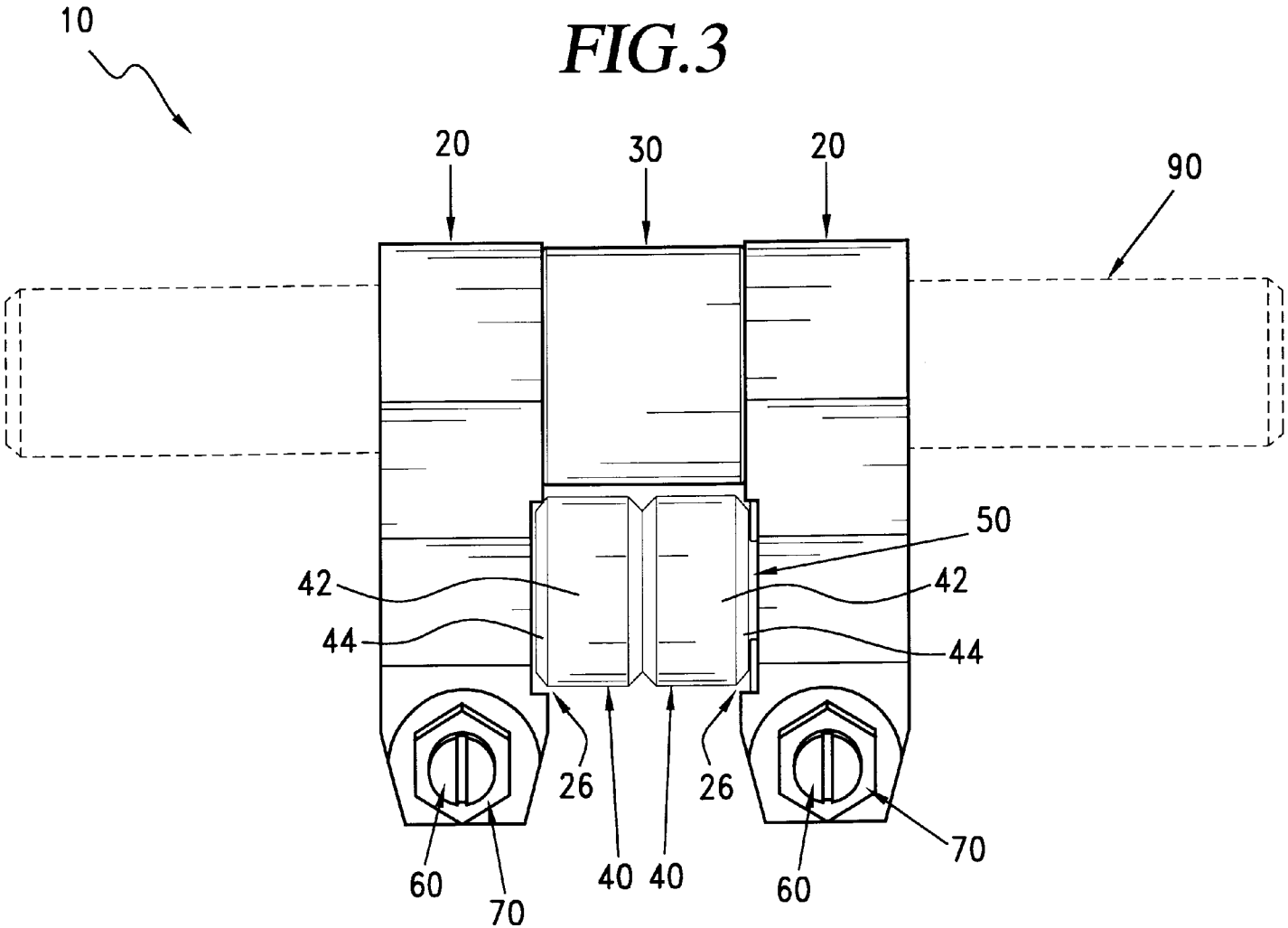
FIG. 3 represents a top view.

Seen in FIG. 3 is instant invention 10 from a top view. Spacer sleeve 30 and bearings 40 approximately of the same width, establish a spaced apart relationship for rocker arm members 20. As best seen here, bearings 40 have chamfered edges 44. Bearing 40 has chamfered edge 44 that abuts circular face notch 26, and chamfered edge 44 of adjacent bearing 40. Interconnecting pin 50, trespasses through bearings 40 and is snugly kept stationary by notched step 28 shown in FIG. 2.

Figure 4:
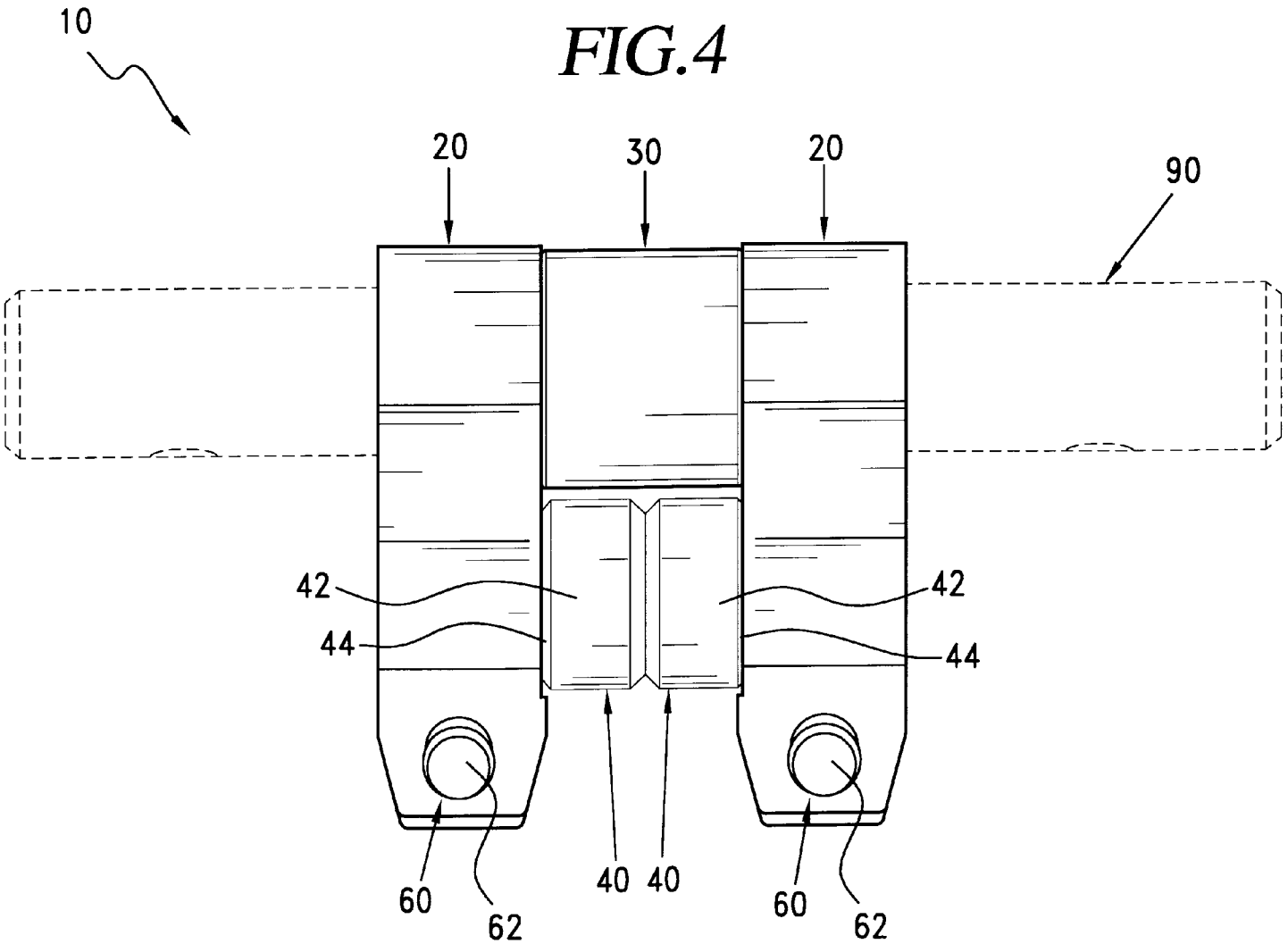
FIG. 4 represents a bottom view.

Seen in FIG. 4 is instant invention 10 from a bottom view. Spacer sleeve 30 and bearings 40 approximately of the same width, establish a spaced apart relationship for rocker arm members 20. Adjustable tip 62 of adjustable screw 60 makes contact with tip 102, seen in FIG. 2, when biased against it.

Figure 5:
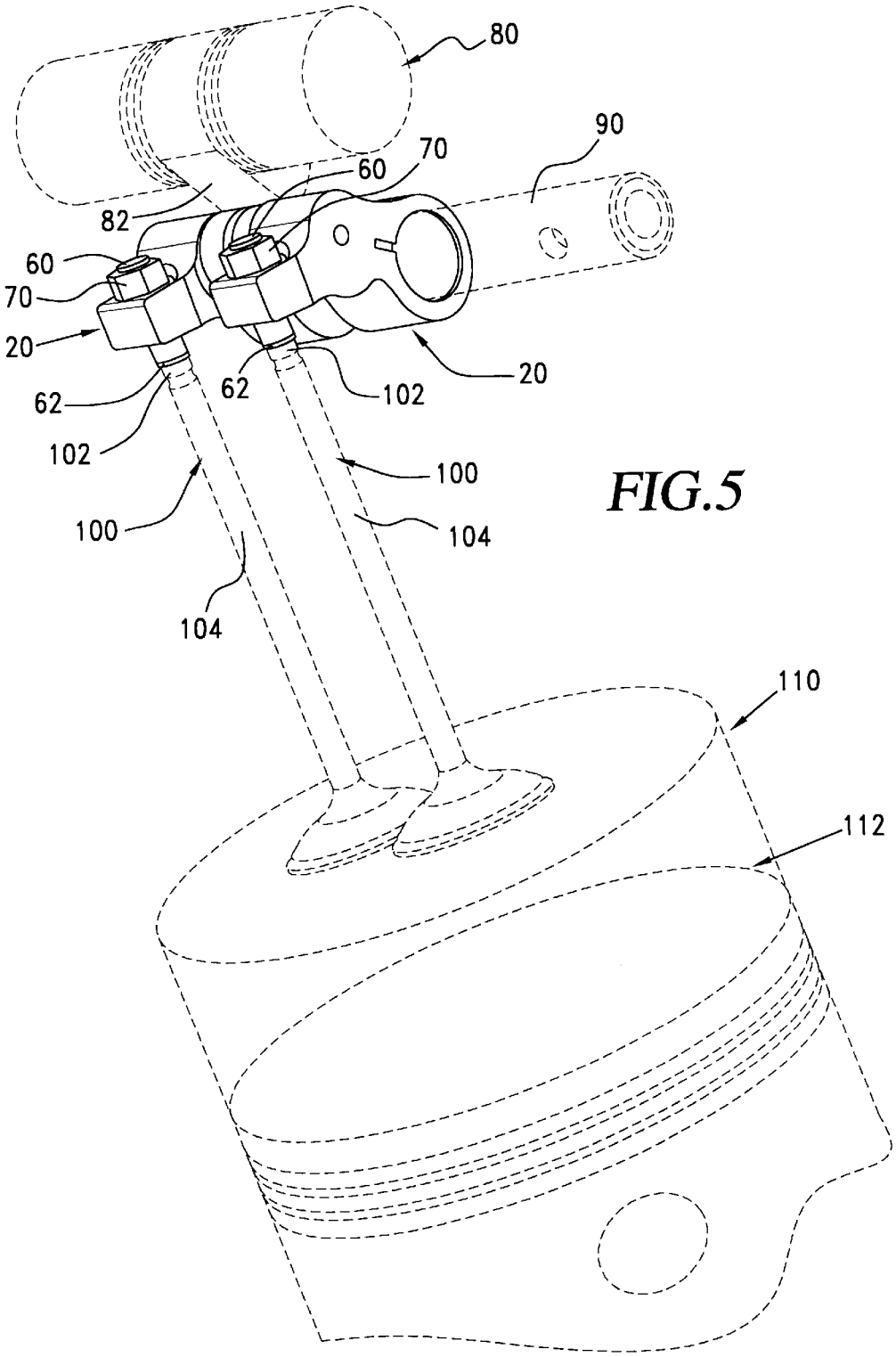
FIG. 5 shows the instant invention with other engine components in phantom.

As best seen in FIG. 5, camshaft lobe 82 is fixedly secured to camshaft 80 and rotates to contact bearings 40. The contact, thus exerts a downward force upon rocker arm members 20 through interconnecting interconnecting pin 50, seen in FIG. 2, to overcome the upward force of valve 100, causing valve stem 104 to vertically travel downward establishing a momentary open valve position within cylinder 110 of a multi-cylinder internal combustion engine, thus regulating intake and exhaust requirements in cooperation with piston 112. Utilizing present invention 10 results in the deactivation of the variable timing electronic control system (not shown), common in most multi-cylinder internal combustion engines. This result is achieved due to the single point of contact between camshaft lobe 82 and bearings 40. In this deactivated mode, other camshaft lobes 82 immediately adjacent (not shown) continue to rotate upon camshaft 80 but do not make contact with arm members 20, and as a result, do not affect the operation of instant invention 10 and ultimately valves 100.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A roller rocker arm system for operation in an internal combustion engine comprising:

A) at least two rocker arm members each having first and second ends, said first end having means for rotatably fitting about a common rocker shaft, said arm members with interconnecting means for interconnecting said arm members, said interconnecting means includes a common pin extending perpendicularly from a predetermined distance between said first end towards said second end without reaching said second end, said common pin partially housed by each of the at least two rocker arm members and at least one bearing having cooperative dimensions to coact with said common pin such that said rocker arm members are positively rotatably fixed with relation to each other in a position in which they each are rotatably mounted on said common rocker shaft;

B) a spacer sleeve assembly having third and fourth ends, said spacer sleeve partially houses said common rocker shaft in between said first end of said arm members with means for rotatably fitting about said common rocker shaft; and C) transmitting means wherein said rocker arm members are adopted for transmitting linear motion to valves, causing said valves to reciprocate along a straight line.

2. The roller rocker arm system for operation in an internal combustion engine set forth in claim 1, wherein said transmitting means includes a camshaft lobe, through operation of said combustion engine, where said camshaft lobe rotates on a camshaft causing said lobe to contact said bearing, exerting a force upon said rocker arm members, establishing a momentary open valve position.

3. The roller rocker arm system for operation in an internal combustion engine set forth in claim 2, wherein said roller rocker arm system eliminates the need of a variable timing electronic control function.

4. The roller rocker arm system for operation in an internal combustion engine set forth in claim 3, wherein said bearing is a roller needle bearing.

5. The roller rocker arm system for operation in an internal combustion engine set forth in claim 4, wherein distance of linear movement of said valves may be adjusted.

* * * * *